US007762790B2

(12) United States Patent
Steinfels et al.

(10) Patent No.: US 7,762,790 B2
(45) Date of Patent: Jul. 27, 2010

(54) AIR COMPRESSOR

(75) Inventors: Craig R. Steinfels, Jackson, TN (US); Scott D. Craig, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 157 days.

(21) Appl. No.: 12/023,522

(22) Filed: Jan. 31, 2008

(65) Prior Publication Data

US 2008/0187447 A1 Aug. 7, 2008

Related U.S. Application Data

(60) Provisional application No. 60/899,582, filed on Feb. 5, 2007.

(51) Int. Cl.
*F04B 53/00* (2006.01)

(52) U.S. Cl. ..... 417/234; 137/565.18

(58) Field of Classification Search ..... 417/234, 417/362, 410.1, 313; 137/565.17, 565.18, 137/899.4; 123/2; 280/43.12, 46, 47.13, 280/47.17, 47.27, 47.19, 659
See application file for complete search history.

(56) References Cited

U.S. PATENT DOCUMENTS

| | | | | |
|---|---|---|---|---|
| 1,186,157 | A | 6/1916 | Abell | |
| 2,434,675 | A | 1/1948 | Simpson | |
| D170,330 | S | 9/1953 | Miller | |
| 2,812,895 | A | 11/1957 | Peeps | |
| 3,837,539 | A * | 9/1974 | Schlegel | 222/609 |
| 4,077,747 | A | 3/1978 | Burenga | |
| 4,389,166 | A | 6/1983 | Harvey et al. | |
| 4,503,812 | A * | 3/1985 | Eberhardt | 123/2 |
| 4,608,946 | A * | 9/1986 | Tanaka et al. | 123/2 |
| 4,621,984 | A * | 11/1986 | Fussell | 417/234 |
| 4,656,687 | A | 4/1987 | Wei | |
| 4,662,551 | A | 5/1987 | Dudley et al. | |
| D293,682 | S | 1/1988 | Liou | |
| 4,834,626 | A * | 5/1989 | Prevosto | 417/415 |
| 5,030,067 | A | 7/1991 | Ushiota et al. | |
| 5,051,068 | A * | 9/1991 | Wong | 417/234 |

(Continued)

FOREIGN PATENT DOCUMENTS

| | | |
|---|---|---|
| DE | M 97 02 295 | 3/1997 |

(Continued)

OTHER PUBLICATIONS

Machine Translation of JP2002243137A.*

(Continued)

*Primary Examiner*—Devon C Kramer
*Assistant Examiner*—Nathan Zollinger
(74) *Attorney, Agent, or Firm*—Harness, Dickey & Pierce, P.L.C.

(57) ABSTRACT

An air compressor package that includes a pancake air tank, which has a pair of convex tank members that are coupled to one another about an equator of the pancake air tank, a motor and a compressor that is driven by the motor. The compressor is coupled in fluid communication with the pancake air tank. The motor and the compressor are arranged relative to the pancake air tank such that a plane taken through the equator of the pancake air tank passes through the motor and the compressor.

20 Claims, 13 Drawing Sheets

U.S. PATENT DOCUMENTS

| | | | | | |
|---|---|---|---|---|---|
| D328,465 | S | | 8/1992 | Schwarz et al. | |
| 5,147,182 | A | | 9/1992 | Timmons | |
| 5,211,558 | A | | 5/1993 | Bailey et al. | |
| D352,292 | S | | 11/1994 | Morgan | |
| D352,293 | S | | 11/1994 | Morgan | |
| 5,370,504 | A | * | 12/1994 | Nagashima | 417/234 |
| 5,399,072 | A | | 3/1995 | Westphal | |
| 5,503,295 | A | * | 4/1996 | Kotarba et al. | 220/581 |
| D377,799 | S | | 2/1997 | Kruzel et al. | |
| D384,676 | S | | 10/1997 | Cypers et al. | |
| 6,089,835 | A | * | 7/2000 | Suzuura et al. | 417/415 |
| 6,094,773 | A | * | 8/2000 | Krentz et al. | 15/321 |
| 6,099,268 | A | | 8/2000 | Pressel | |
| 6,102,679 | A | * | 8/2000 | Brown | 417/550 |
| 6,146,108 | A | * | 11/2000 | Mullendore | 417/234 |
| D440,578 | S | | 4/2001 | Nolan | |
| D444,796 | S | | 7/2001 | Morgan | |
| D444,797 | S | | 7/2001 | Davis et al. | |
| D444,798 | S | | 7/2001 | Morgan | |
| D452,253 | S | | 12/2001 | Matthew et al. | |
| 6,375,437 | B1 | * | 4/2002 | Nolan | 417/234 |
| 6,386,833 | B1 | | 5/2002 | Montgomery | |
| 6,406,270 | B1 | | 6/2002 | Kopel | |
| D460,763 | S | | 7/2002 | Buck | |
| D461,196 | S | | 8/2002 | Buck | |
| 6,485,269 | B1 | | 11/2002 | Matthew et al. | |
| D471,918 | S | | 3/2003 | Buck | |
| D471,919 | S | | 3/2003 | Buck | |
| 6,582,201 | B2 | | 6/2003 | Lucchi | |
| 6,773,132 | B2 | | 8/2004 | Gilligan et al. | |
| 6,942,464 | B2 | * | 9/2005 | Brashears et al. | 417/234 |
| 6,991,436 | B2 | | 1/2006 | Beckman et al. | |
| 6,991,437 | B2 | * | 1/2006 | Cherry et al. | 417/234 |
| 6,994,528 | B2 | * | 2/2006 | Brashears et al. | 417/234 |
| 6,994,529 | B2 | * | 2/2006 | Downes | 417/234 |
| 7,128,344 | B2 | * | 10/2006 | Sharp | 280/830 |
| 7,140,845 | B2 | * | 11/2006 | Hsiao | 417/234 |
| 7,225,959 | B2 | | 6/2007 | Patton et al. | |
| 7,458,784 | B2 | * | 12/2008 | Vos et al. | 417/234 |
| 2004/0047745 | A1 | * | 3/2004 | Burkholder et al. | 417/234 |
| 2006/0067836 | A1 | * | 3/2006 | Smith et al. | 417/234 |
| 2006/0104825 | A1 | | 5/2006 | Etter et al. | |
| 2006/0104830 | A1 | * | 5/2006 | Fields | 417/360 |
| 2006/0104834 | A1 | * | 5/2006 | Stilwell | 417/410.1 |
| 2008/0181794 | A1 | * | 7/2008 | Steinfels et al. | 417/234 |
| 2008/0219860 | A1 | * | 9/2008 | Caito et al. | 417/234 |

FOREIGN PATENT DOCUMENTS

| | | | | |
|---|---|---|---|---|
| DE | 498 08 081 | | | 8/1998 |
| DE | 401 07 825 | | | 8/2001 |
| DE | 40401476 | | | 3/2004 |
| DE | 40406313 | | | 11/2004 |
| EP | 0 595 459 | | | 5/1994 |
| FR | 1140265 | | | 1/1956 |
| FR | 1263641 | | | 5/1961 |
| FR | 002597928 | A1 | | 10/1987 |
| FR | DM/047819 | | | 4/1999 |
| FR | DM/054178 | | | 11/2000 |
| FR | DM/057951 | | | 8/2001 |
| GB | 1 579 897 | | | 11/1980 |
| GB | 2 216 960 | | | 10/1989 |
| JP | 357186078 | A | | 11/1982 |
| JP | 402199278 | A | | 8/1990 |
| JP | 2002243137 | | * | 8/2002 |
| JP | 2007211662 | A | * | 8/2007 |
| JP | 2007231815 | A | * | 9/2007 |
| WO | WO 01/24941 | | | 4/2001 |

OTHER PUBLICATIONS

Printout illustrating commercially available air compressors marketed by Porter Cable (taken from www.portercable.com).

Printout illustrating air compressors available through PowerToolDepot.com (taken from www.powertooldepot.com).

Printout of Specifications for Campbell Hausfeld Model FP2000 Compressor (taken from www.chpower.com).

Printout of specifications from press release for Stanley Model CWC200ST (taken from www.stanleyworks.com).

Printout of Specifications for Bostitch Model CAP2045ST-OL 2 (taken from www.amazon.com).

Printout of Rolair models D1500HPV5, OD1500HMSS4, D2000HSSV5 & D075LS3 (taken from www.rolair.net).

PCT International Preliminary Report on Patentability relating to International application No. PCT/US2008/001459 dated Aug. 11, 2009.

* cited by examiner

AIR COMPRESSOR

CROSS-REFERENCE TO RELATED APPLICATIONS

This application claims the benefit of U.S. Provisional Patent Application Ser. No. 60/899,582 filed Feb. 5, 2007 and entitled "Air Compressor". The disclosure of U.S. Provisional Patent Application Ser. No. 60/899,582 is hereby incorporated by reference as if fully set forth in its entirety herein.

INTRODUCTION

The present disclosure generally relates to the field of portable air compressors and more particularly to hand portable air compressors with improved portability and ruggedness.

Small air compressors are frequently employed around the home, workshop and work site. A number of very small and lightweight compressors are available for home, recreation and other light duty uses such as inflating sports or recreation equipment or for emergency use in inflating a car tire. Such tasks require relatively low-pressure compressed air and/or relatively low airflow rates. Weight is kept low and portability is maximized in these designs by use of small, low volume and/or low-pressure compressors powered by small lightweight electric motors. Additionally, significant weight, size and cost savings are achieved by the omission of a high-pressure vessel (i.e., air tank), as well as an oil lubrication system.

Many jobs, however, require higher air pressures, and/or greater instantaneous air flow demands which typically exceed the capacity of the hobby or recreational use compressors. To satisfy the demands of higher air pressure and higher airflow tasks it is necessary to increase the size of the compressor and the related motor or engine. Such units typically include an air tank or other pressure vessel that can be employed to meet a relatively high instantaneous air flow demand. The tank, usually with an output regulator, can hold a quantity of pressurized air to meet peak demands from serviced loads, while allowing the use of a smaller and lighter compressor that charges the tank and is capable of meeting the average compressed air flow rate for the intended use.

The air tank and the larger compressor that are typically required to meet the desired pressure and airflow levels substantially increase the weight and overall size of the compressor package. Units designed for high pressure and high volume tasks can reach a weight and size where a motor vehicle mounted or towed trailer configuration is the only practical form. Still, there are a range of intermediate capacity air compressors that are commonly employed in and around construction sites. These air compressors are termed "man portable air compressors".

Current models of man portable air compressor packages comprise a stand or supporting structure on or in which are mounted a motor or engine, an air compressor, an air tank, a discharge manifold and various valves, instrumentation and controls. Many of the larger portable configurations are provided with wheels, in what is often referred to as a wheelbarrow configuration, so that they can be moved by a single user. Examples of wheeled air compressors include Models D55170 and D55270, which are marketed by DeWalt.

Still, some users of intermediate capacity professional grade compressors find it necessary or desirable to have a compressor that is capable of being lifted and carried by hand. One common approach taken by air compressor manufacturers to improve the portability of such intermediate capacity professional grade compressors has been to redesign the air compressor so as to reduce its weight. Despite such efforts, intermediate capacity professional grade compressors frequently weigh more than 50 pounds and thus remain difficult to lift and move by hand, even for those users who are physically strong.

Aside from the issue of their weight, hand-portable intermediate capacity professional grade compressors are also known to be quite cumbersome to transport. In this regard, the configurations that use two cylindrical tanks or a single pancake tank (i.e., a cylindrical tank of large diameter but small height with convex ends) have become common, as have the mounting schemes for mounting the compressor and the motor. For example, configurations that use two cylindrical tanks typically mount the compressor and motor alongside the tanks, whereas configurations that use a single pancake tank typically mount the compressor and motor on an end (e.g., top) of the tank.

These conventional air compressor arrangements provide a package with a relatively large base or footprint, and a center of gravity that is positioned in an approximately centered position within the footprint. While such arrangements provide the air compressor with a configuration that is relatively stable during its operation, lifting and carrying air compressors with these configurations tends to be rather awkward and difficult. In this regard, these configurations typically employ a handle (for lifting and carrying the air compressor) that is attached to an appropriate structure, such as the stand or the air tank, at a location that is located vertically above the center of gravity of the entire air compressor package. The handle is generally oriented in a manner that requires the air compressor package to be lifted vertically upwards and carried in an orientation that is substantially the same as the orientation in which it is operated.

Lifting and carrying the known intermediate air compressor packages in this manner, however, is relatively difficult, since the footprint of these air compressor packages tends to be relatively large and thus requires the user to hold the air compressor package with a somewhat outstretched arm such that the wrist of the user is in a state of flexion. In an effort to bring the air compressor package's center of gravity closer to the central axis of the user, the user will typically tilt their upper body away from the load of the air compressor package and thus will lift and transport the air compressor package with a body posture that is uncomfortable and awkward.

U.S. Pat. No. 6,942,464 entitled "Air Compressor With Improved Hand Portability", the disclosure of which is hereby incorporated by reference as if fully set forth in detail herein, describes various air compressor packages with improved hand portability. The air compressor packages employ one or more relatively long, cylindrical tanks. There remains a need in the art, however for a somewhat smaller capacity air compressor package of the type that is typically referred to as a "pancake" compressor.

SUMMARY

In one form, the present teachings provide an air compressor package that includes a pancake air tank, which has a pair of convex tank members that are coupled to one another about an equator of the pancake air tank, a motor and a compressor that is driven by the motor. The compressor is coupled in fluid communication with the pancake air tank. The motor and the compressor are arranged relative to the pancake air tank such that a plane taken through the equator of the pancake air tank passes through the motor and the compressor.

In another form, the present teachings provide air compressor package that includes a pancake air tank, which has a pair of convex tank members that are coupled to one another about an equator of the pancake air tank, a handle, which is coupled to the pancake air tank and has a widened C-shape, a motor and a compressor that is driven by the motor. The compressor is coupled in fluid communication with the pancake air tank. The motor and the compressor are disposed between the pancake air tank and the handle.

In yet another form, the present teachings provide an air compressor package that includes a pancake air tank, a handle, a housing, a motor, a compressor, and a manifold assembly. The pancake air tank has a pair of convex tank members that are coupled to one another about an equator of the pancake air tank. The handle is coupled to the pancake air tank and includes a first handle portion and a second handle portion. The housing is coupled to the pancake air tank and the handle. The housing defines an internal cavity and at least partially shrouds the pancake air tank and the handle. The motor is housed in the internal cavity of the housing. The compressor is driven by the motor and housed in the internal cavity of the housing. The compressor is in fluid communication with the pancake air tank. The manifold assembly is coupled in fluid communication with the pancake air tank and includes a gauge, a regulator and an outlet coupling. The air compressor package has a first operating position in which the equator of the pancake air tank is positioned vertically and the first portion of the handle is generally parallel to a first surface on which the air compressor package is positioned. The air compressor package has a first hand-carried transport position in which the first portion of the handle is adapted to be engaged by a single hand of a user to transport the air compressor package such that the first portion of the handle is disposed above the pancake air tank. The air compressor package has a second hand-carried transport position in which the second portion of the handle is adapted to be engaged by the single hand of the user to transport the air compressor package such that the second portion of the handle is disposed above the pancake air tank. The second transport position is rotated by an angle of about 90 degrees from the first transport position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
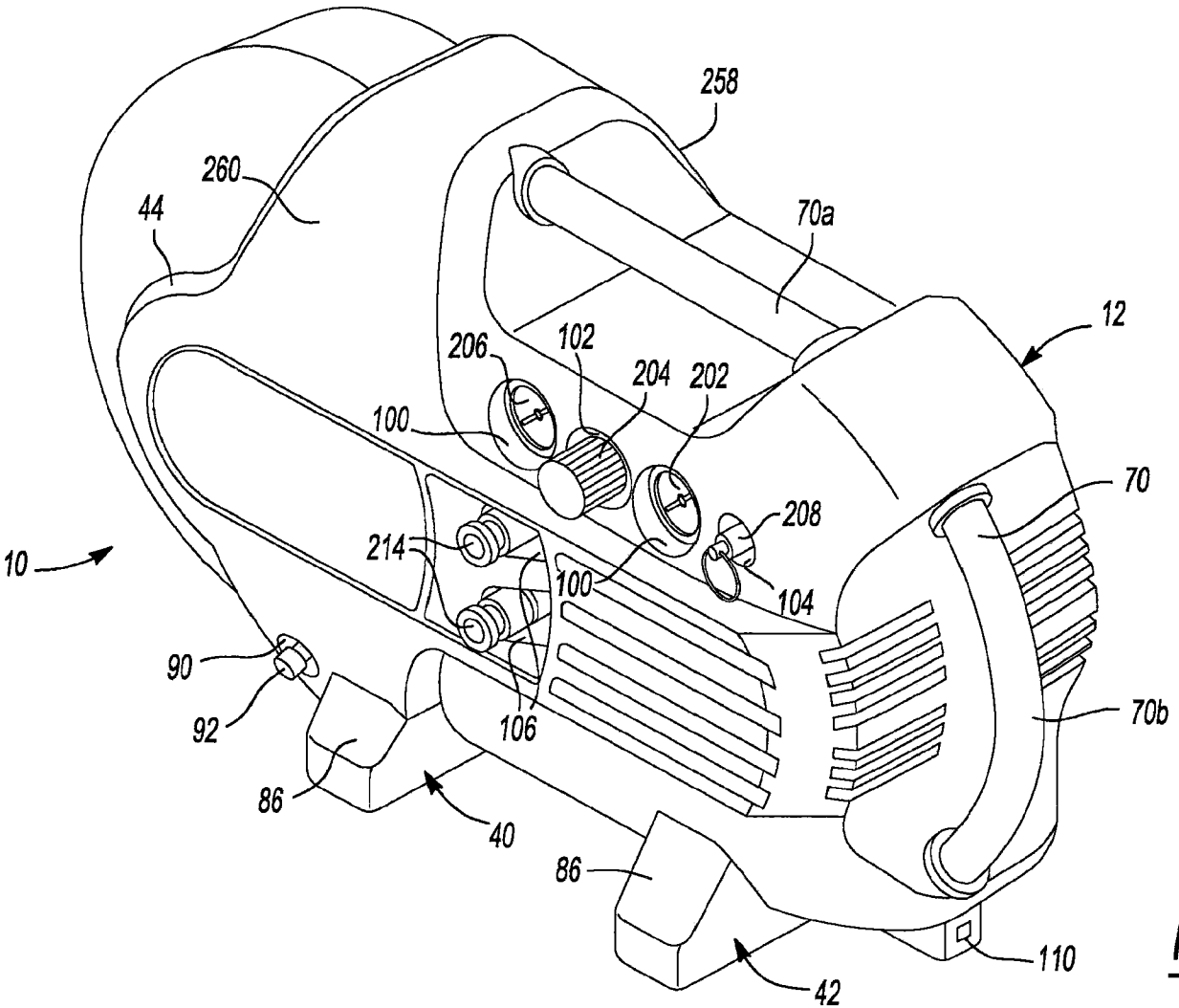
FIG. 1 is a front perspective view of an air compressor package constructed in accordance with the teachings of the present disclosure.
Figure 2:
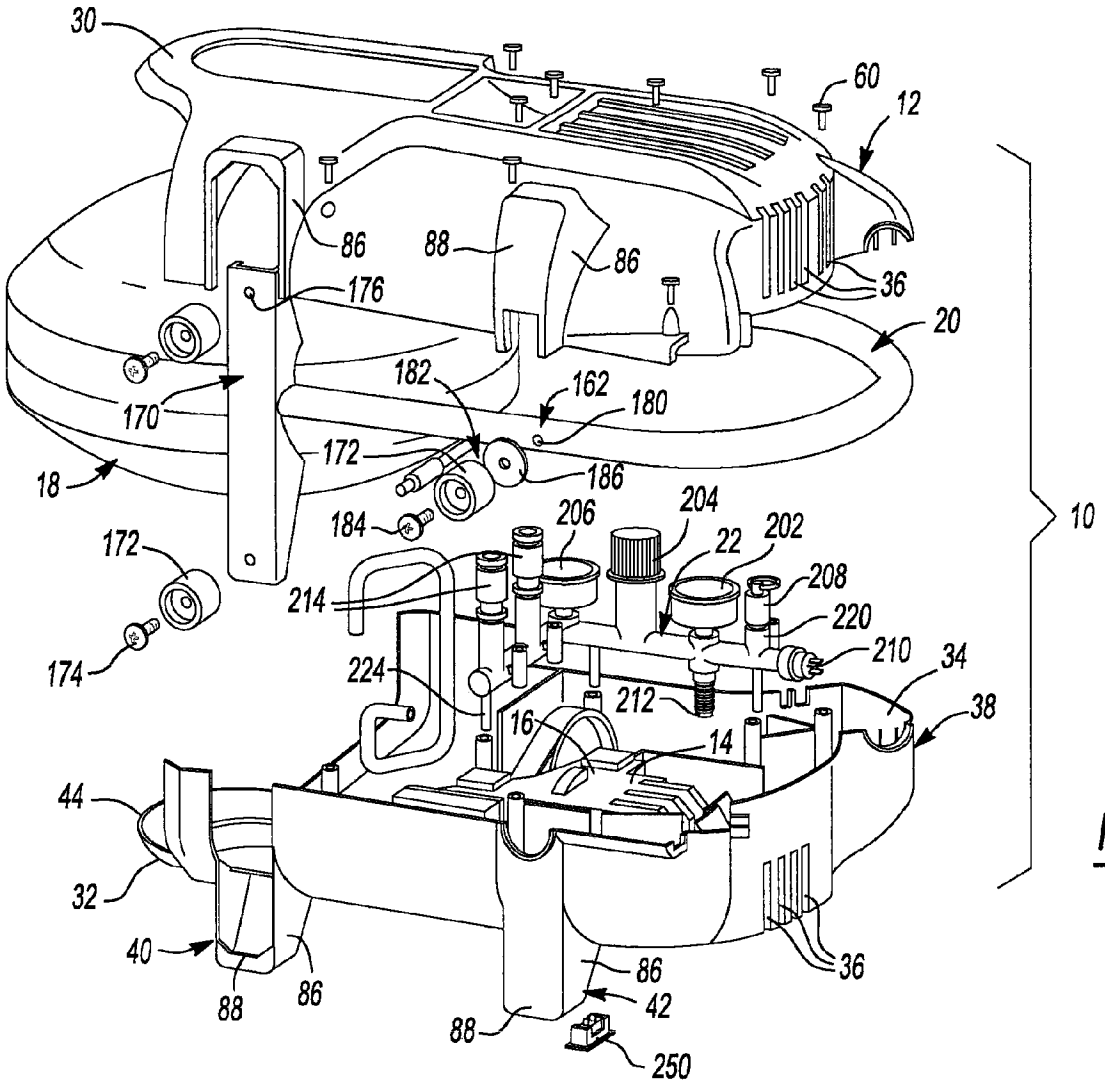
FIG. 2 is an exploded perspective view of the air compressor package of FIG. 1.

With reference to FIGS. 1 and 2 of the drawings, an air compressor package constructed in accordance with the teachings of the present invention is generally indicated by reference numeral 10. The air compressor package 10 can include a housing 12, a motor 14, a compressor 16, an air tank assembly 18, a frame assembly 20 and a manifold assembly 22.

The housing 12 can include a first housing shell 30 and a second housing shell 32 that can be formed of a rugged plastic material. The first and second housing shells 30 and 32 can cooperate to define an internal cavity 34, a plurality of vents 36, a handle mount 38, a first foot mount 40, a second foot mount 42 and a tank mount 44.

Figure 3:
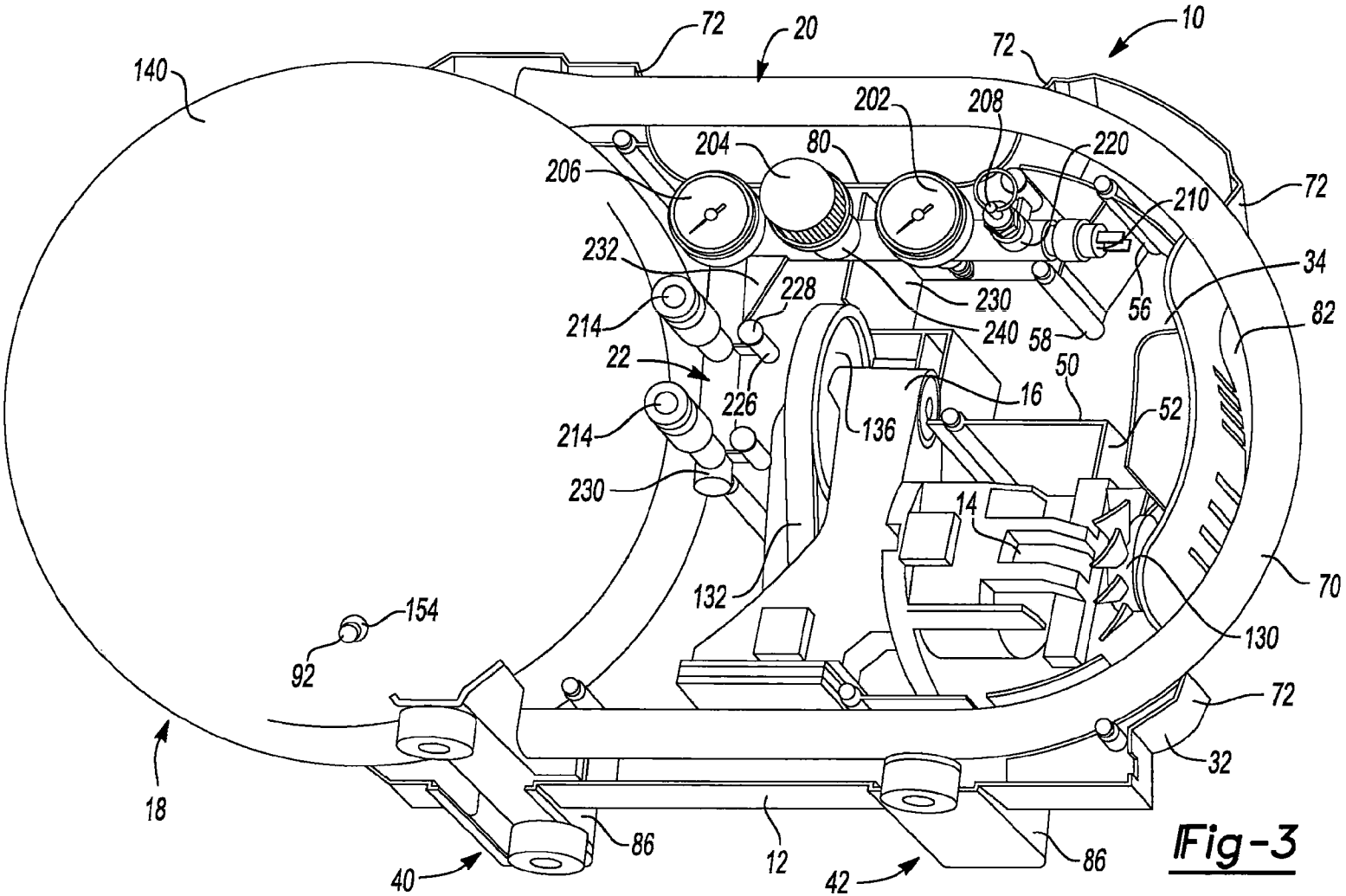
FIG. 3 is a perspective view of a portion of the air compressor package of FIG. 1 with the first housing shell removed.
Figure 4:
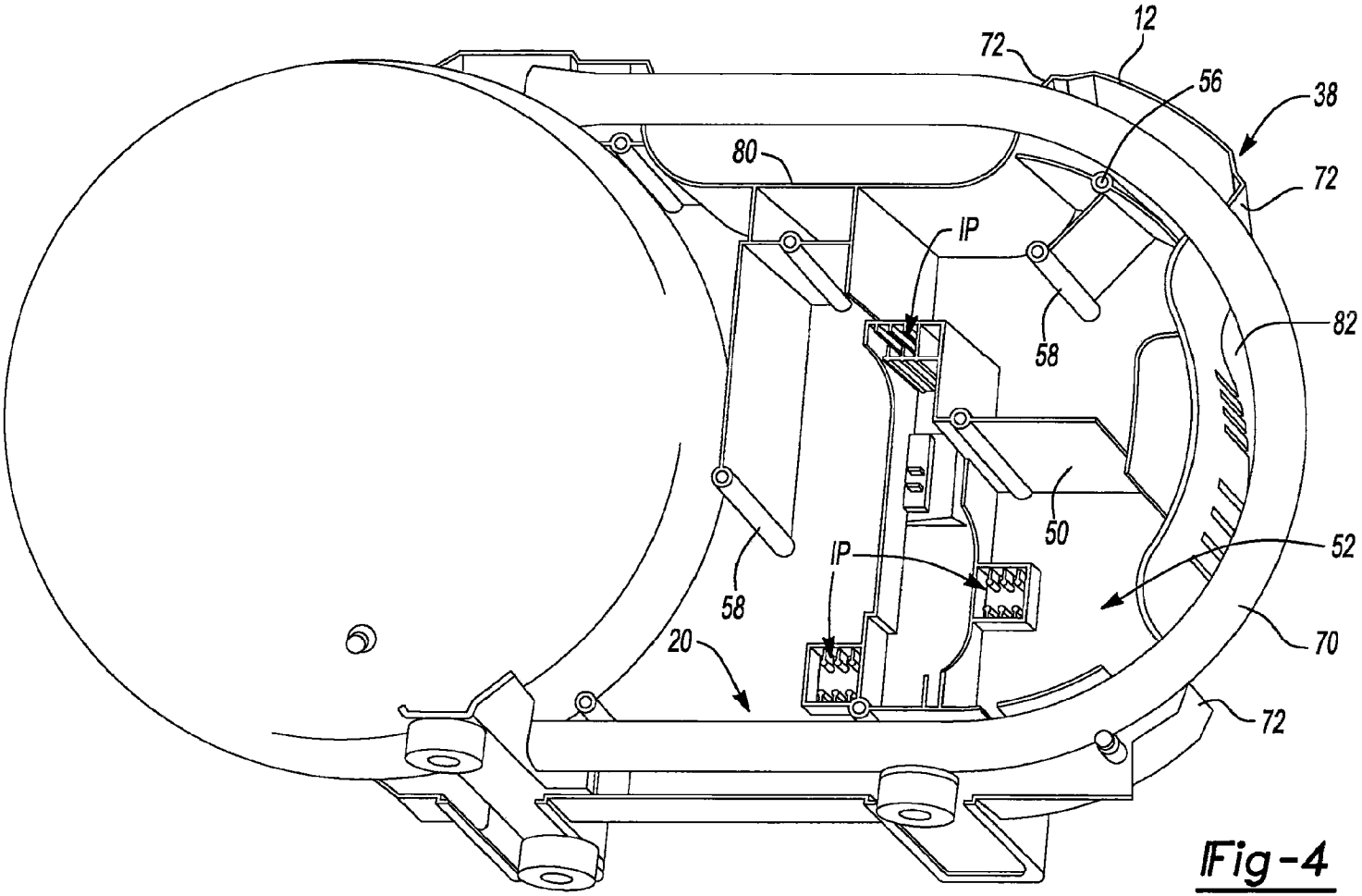
FIG. 4 is a perspective view of a portion of the air compressor package of FIG. 1 illustrating a portion of the air tank assembly and the frame assembly as inserted into the second housing shell.

With reference to FIGS. 2 through 4, one or more partition walls 50 can be disposed in the internal cavity 34 to define a motor/compressor mount 52 into which the motor 14 and the compressor 16 may be received. The motor/compressor mount 52 can be sized and shaped to hold the motor 14 and/or the compressor 16 to thereby effectively fix the motor 14 and the compressor 16 relative to the housing 12 without employing threaded fasteners (not shown) to fixedly but removably couple the motor 14 and/or the compressor 16 to one or both of the first and second housing shells 30 and 32. It will be appreciated, however, that while such "fastener-less" assembly is desirable from the stand point of a reduction in the quantity of parts and a reduction in assembly labor, the motor 14 and/or the compressor 16 could, if desired, be fastened (e.g., via one or more threaded fasteners, clips, etc.) to one or both of the first and second housing shells 30 and 32. Resilient isolators RI (FIG. 8) can be mounted to one or both of the lateral sides of the motor 14 and/or the compressor 16 to eliminate or limit movement of the motor 14 and the compressor 16 within the motor/compressor mount 52. The resilient isolators RI (FIG. 8) can be mounted in an interference-fit or slip-fit manner onto projections formed onto the structure of the motor 14 and/or the compressor 16. The resilient isolators RI (FIG. 8) can be received in isolator pockets IP formed in the housing 12 to thereby fix the location of the resilient isolators RI (FIG. 8) (and thereby the motor 14 and the compressor 16) relative to the housing 12.

The second housing shell 32 can include a plurality of first bosses 56 and a plurality of second bosses 58. The first bosses 56 are configured to threadably receive threaded fasteners 60 that are inserted through corresponding holes in the first housing shell 30 to thereby fixedly but removably couple the first and second housing shells 30 and 32 to one another. The second bosses 58 can extend inwardly into the internal cavity 34 to facilitate the coupling of the manifold assembly 22 to the second housing shell 32 as will be described in more detail, below. The vents 36 can be formed through one or both of the first and second housing shells 30 and 32 and can permit air to be drawn into and dispensed from the internal cavity 34.

Figure 5:
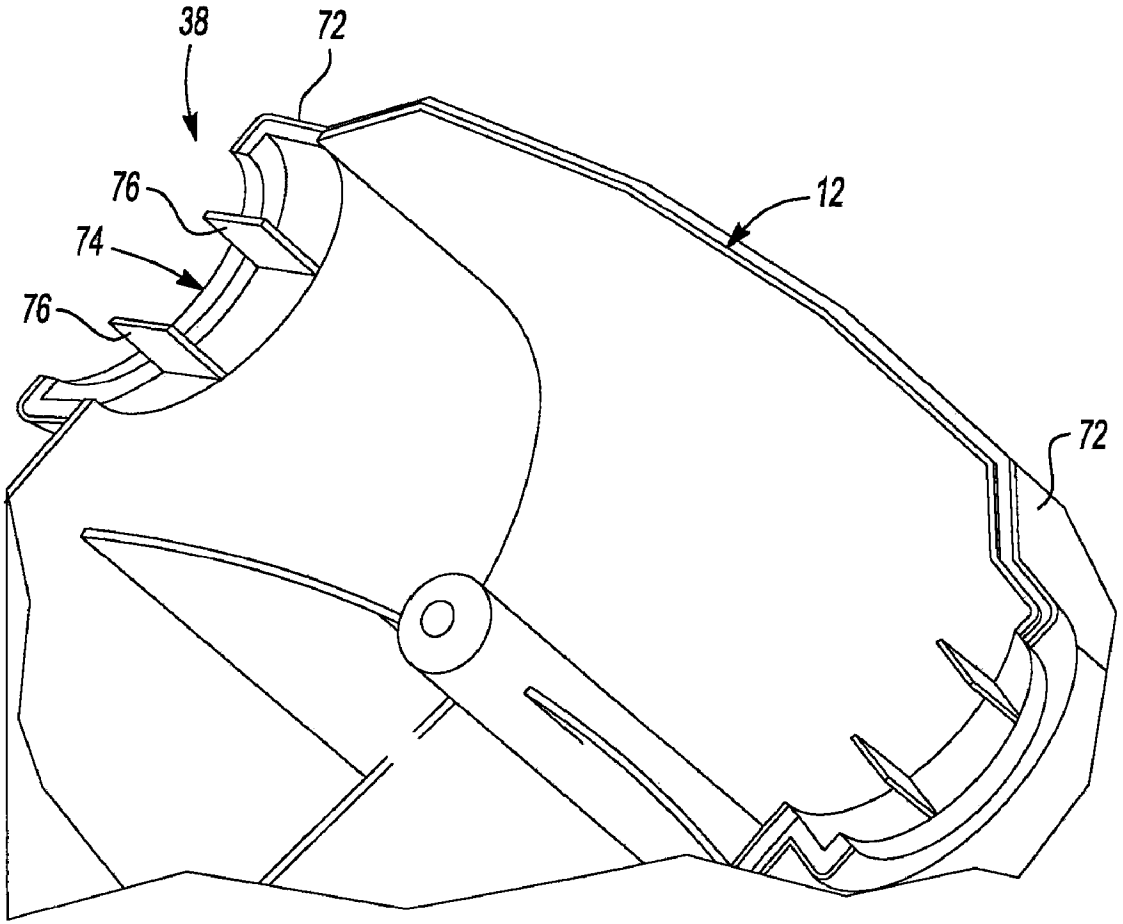
FIG. 5 is an enlarged view of a portion of the second housing shell illustrating a portion of the handle mount in more detail.

With reference to FIGS. 3 through 5, the handle mount 38 can comprise structure that can be configured to engage and support a handle 70 when the frame assembly 20 is assembled to the housing 12. The handle mount 38 can include a plurality of collars 72, each having an aperture 74 through which the handle 70 can extend, and ribs 76 that can cooperate to align and fix the handle 70 to the housing 12. In the example provided, the handle mount 38 includes a first recessed area 80 that is disposed on the top of the air compressor package 10 and a second recessed area 82 that is disposed on a side of the air compressor package 10 opposite the air tank assembly 18. The first and second recessed areas 80 and 82 can provide clearance between the handle 70 and the exterior surface of the housing 12 in which a user may insert their hand (not shown) to grasp the handle 70. Although the handle 70 has been illustrated and described herein as being substantially uniform in diameter throughout its length, it will be appreciated from this disclosure that one or more portions of the handle 70 may be formed differently so as to lock the handle 70 to the housing 12 in a desired area. For example, the one or more portions of the handle 70 between adjacent collars 72 may be expanded in diameter at one or more locations to thereby inhibit relative movement between the handle 70 and the handle mount 38. As another example, one or more portions of the handle 70 between adjacent collars 72 may be reduced in diameter (e.g., a groove could be rolled into the material that forms the handle 70 prior to or after the handle 70 is bent) and a portion of the handle mount 38 could be received into the reduced diameter portion to thereby lock the handle 70 to the handle mount 38. As yet another example, holes (not shown) could be punched into the material that forms the handle prior to the bending of the handle 70 and a portion of the handle mount 38 could be received into the holes to thereby lock the handle 70 to the handle mount 38.

Returning to FIGS. 1 through 3, the first and second foot mounts 40 and 42 can be axially spaced apart from one another along the longitudinal axis of the air compressor package 10 and can include triangular structures 86 that extend outwardly from the first and second housing shells 30 and 32. The bottom surfaces 88 of the triangular structures 86 can be slotted to receive respective portions of the frame assembly 20.

The tank mount 44 can include structure that can partially or completely shroud the air tank assembly 18. Configuration in this manner provides an aesthetically cohesive appearance. In the particular example provided, the tank mount 44 is configured to partially shroud the air tank assembly 18 and to provide an aperture 90 through which a drain valve 92 associated with the air tank assembly 18 can be received through. The aperture 90 can be disposed proximate the triangular structure 86 on the first housing shell 30 associated with the first foot mount 40.

Figure 6:
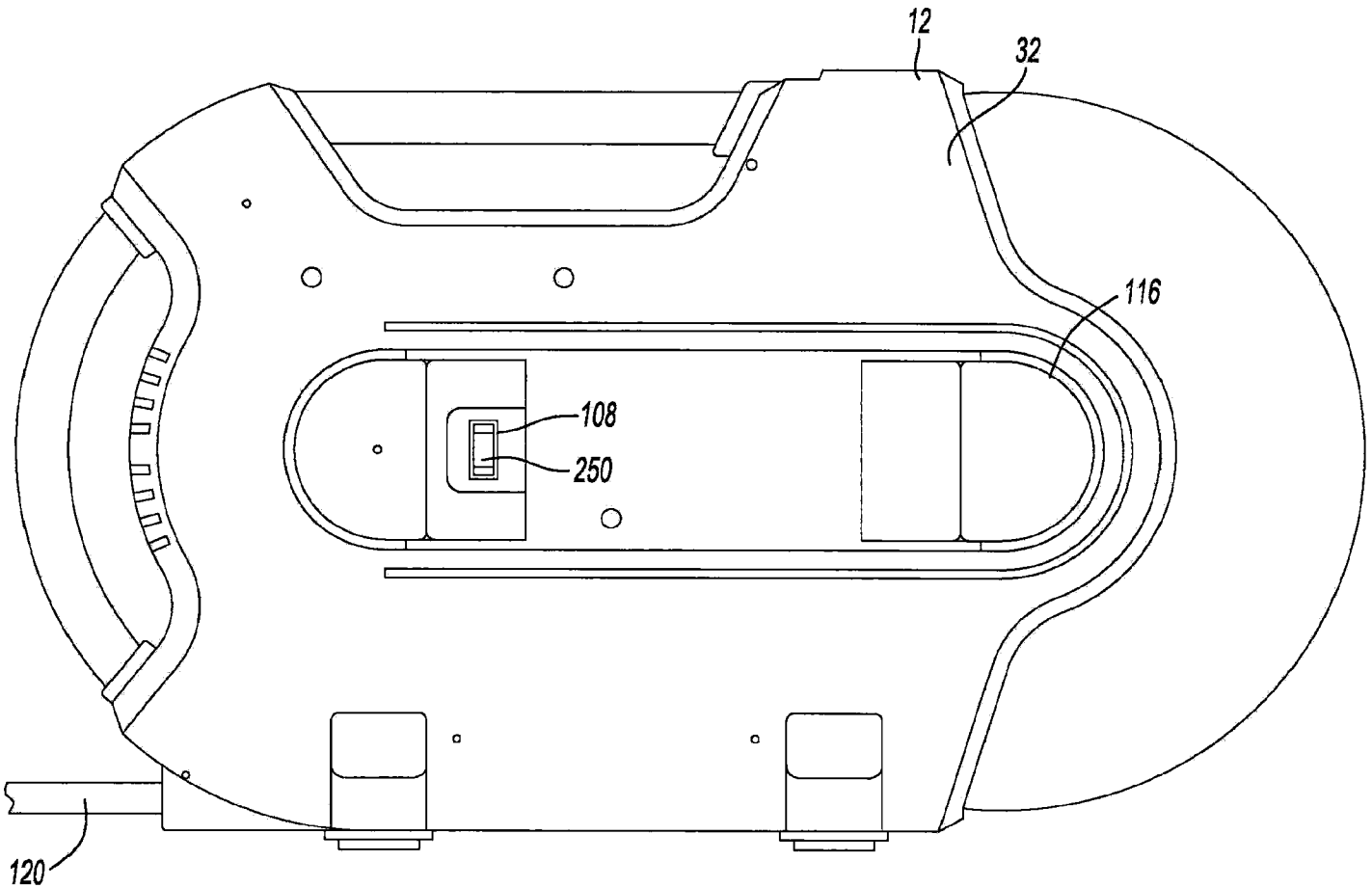
FIG. 6 is a rear elevation view of the air compressor package of FIG. 1.
Figure 7:
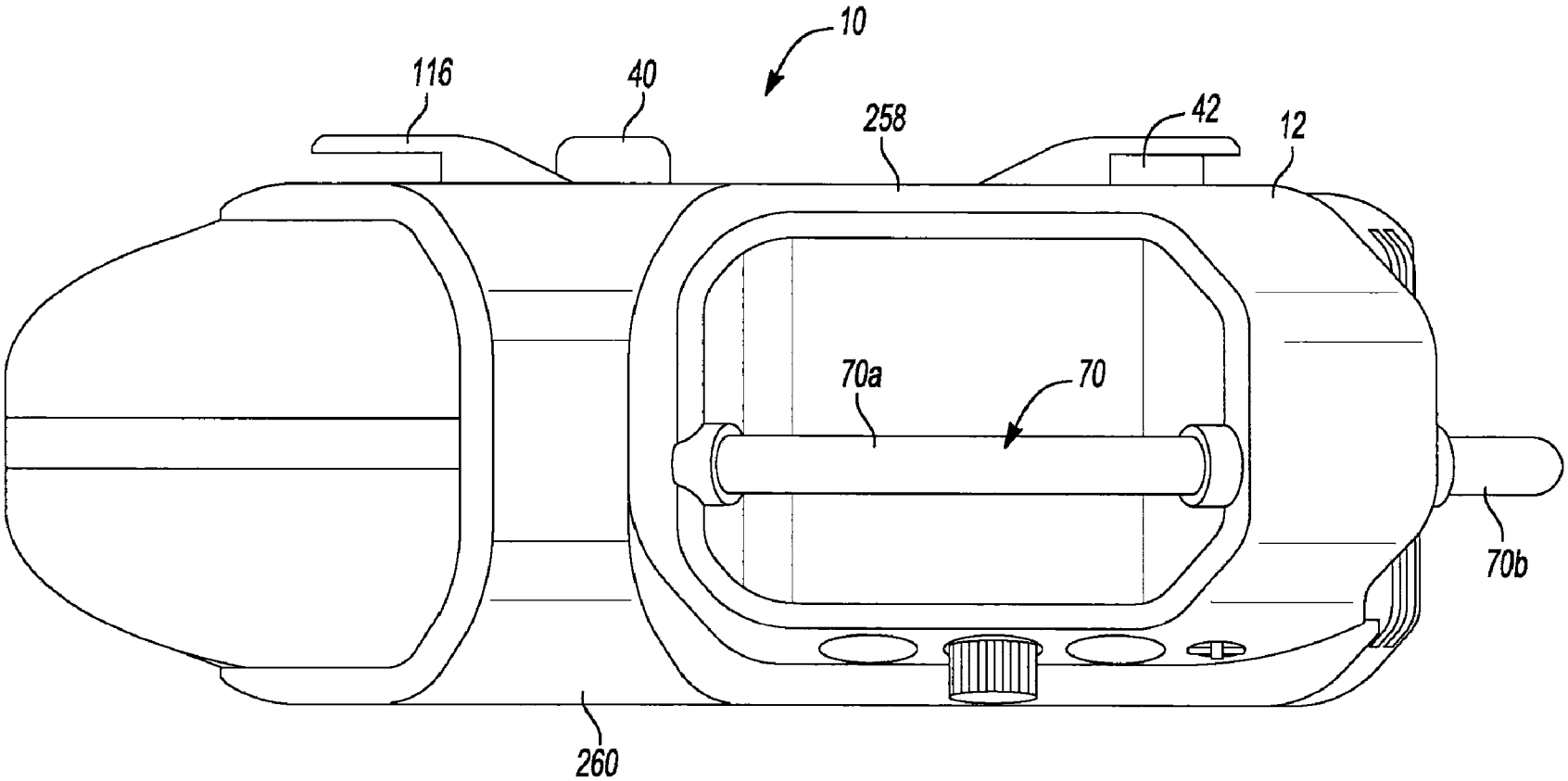
FIG. 7 is a top plan view of the air compressor package of FIG. 1.

With reference to FIGS. 1, 6 and 7, the housing 12 can define a plurality of gauge apertures 100, a regulator aperture 102, a relief valve aperture 104 and a pair of coupling apertures 106, which can be formed through the first housing shell 30, a switch aperture 108 which can be formed through the second housing shell 32, and a cord aperture 110, which can be formed through the first and second housing shells 30 and 32. The second housing shell 32 can define a cord wrap structure 116 that permits a power cord 120 associated with the motor 14 (FIG. 2) to be coiled about the housing 12 for storage.

Figure 8:
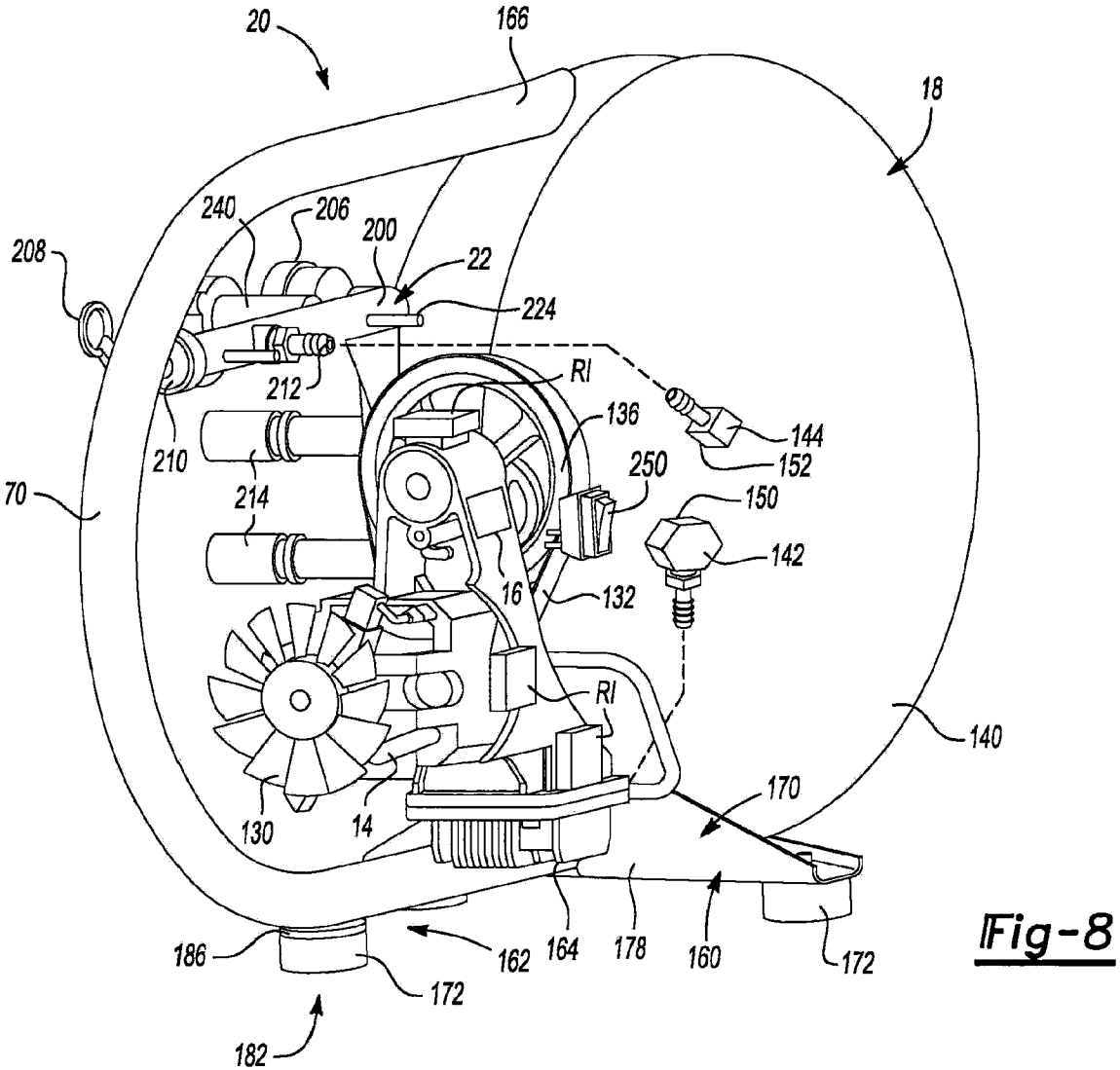
FIG. 8 is a rear perspective view of the air compressor package of FIG. 1 with the housing removed.

With reference to FIGS. 3 and 8, the motor 14 and the compressor 16 can be conventional in their construction and operation and as such, need not be discussed in significant detail herein. Briefly, the motor 14 can be any type of motor, such as an alternating-current universal motor that can receive electrical power via the power cord 120 (FIG. 6). A fan 130 can be coupled to the output shaft (not specifically shown) of the motor 14 and can circulate cooling air over the motor 14 and the compressor 16. Rotary power can be transmitted to the compressor 16 via a belt 132, a motor pulley (not shown) and a compressor pulley 136. The compressor 16 can likewise be any type of compressor, such as an oil-less compressor.

The air tank assembly 18 can include an air tank 140, an inlet fitting 142, an outlet fitting 144 and the drain valve 92. The air tank 140 can be a "pancake-style" tank having a pair of convex tank members that can be welded to one another about the equator of the air tank 140. In the particular example provided, the air tank 140 is about 14 inches in diameter and about 10 inches in depth and has a capacity of about 4 gallons. The air tank 140 can include an inlet boss 150, which is configured to receive the inlet fitting 142, an outlet boss 152, which is configured to receive the outlet fitting 144, and a drain boss 154 that is configured to receive the drain valve 92. The inlet fitting 142 can include a check valve (not specifically shown) that inhibits air from returning to the compressor 16 from the air tank 140. The inlet fitting 142 can be configured to be connected to a fluid conduit, such as a hose (schematically shown in dashed line in FIG. 8) connected to the compressor 16, to thereby couple in fluid communication the air tank 140 and the compressor 16. The outlet fitting 144 can be configured to be connected to a fluid conduit, such as a hose (schematically shown in dashed line in FIG. 8) connected to the manifold assembly 22, to thereby couple in fluid communication the air tank 140 and the manifold assembly 22. The drain valve 92 can be any type of valve, such as a ball valve.

With additional reference to FIG. 1, the drain boss 154 can position the drain valve 92 so as to dispense fluid from the air tank 140 downwardly toward the ground. The drain valve 92 can extend through the aperture 90 in the first housing shell 30 proximate the first foot mount 40. The drain valve 92 can extend from the housing 12 by a limited distance such that if the air compressor package 10 is tipped over, the first foot mount 40 will prevent contact between the drain valve 92 and the ground.

Figure 9:
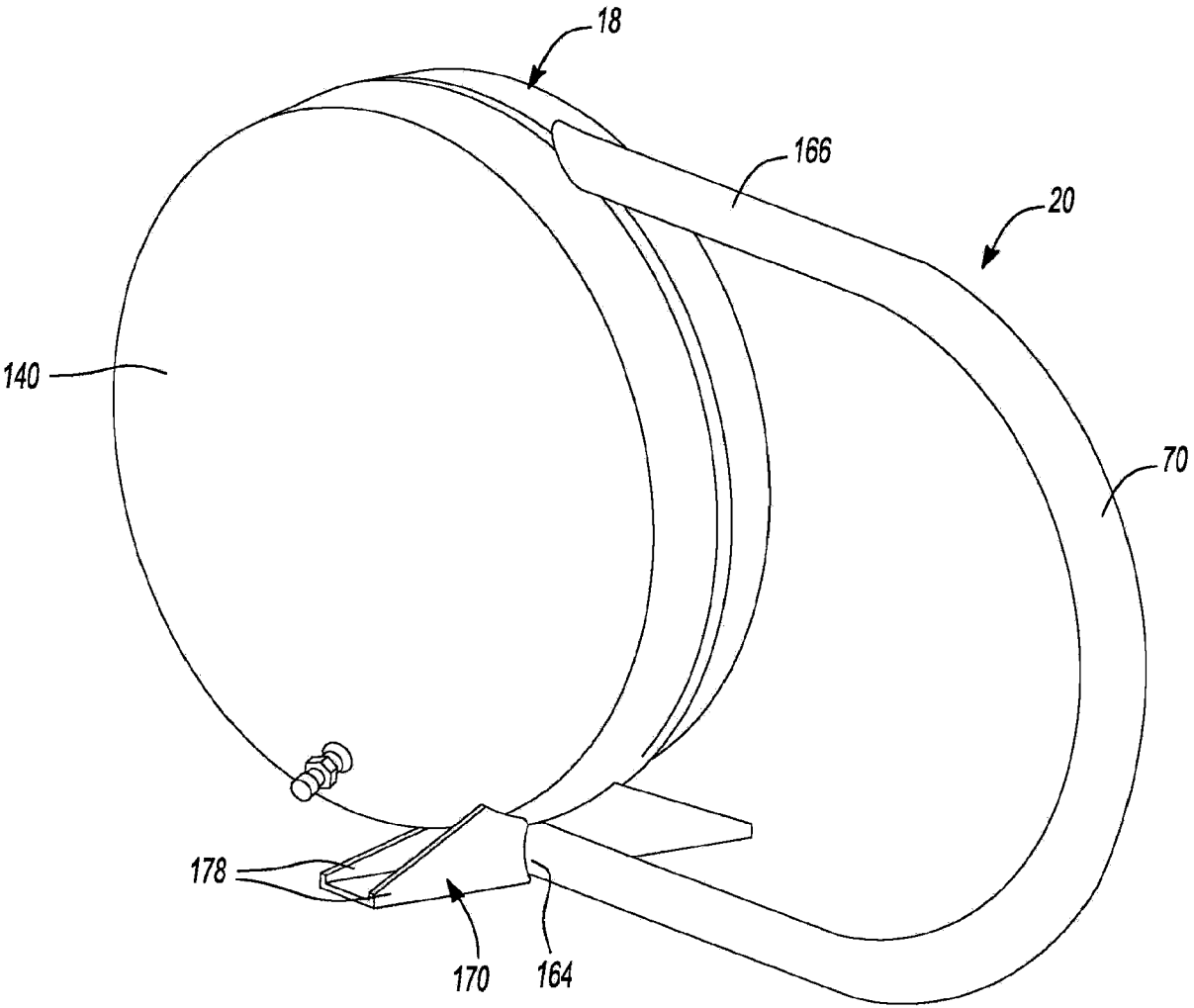
FIG. 9 is a perspective view of the air tank assembly and the frame assembly.
Figure 10:
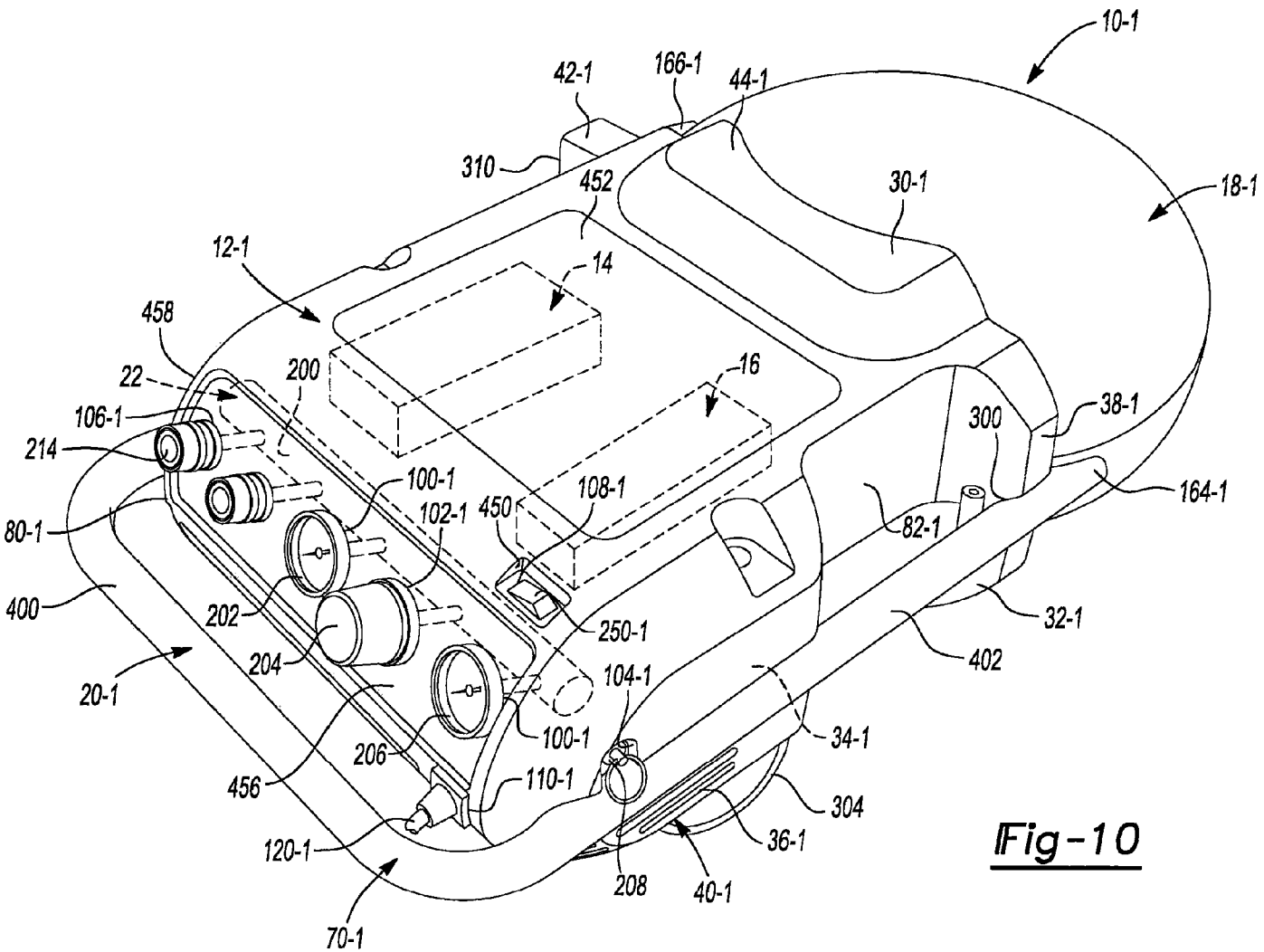
FIG. 10 is a perspective view of another air compressor package constructed in accordance with the teachings of the present disclosure, the air compressor package being oriented in an operating orientation.

With reference to FIGS. 2, 8 and 9, the frame assembly 20 can include the handle 70, a first foot assembly 160 and a second foot assembly 162. The handle 70 can be formed of a suitable metal tubing that can be formed in a widened C-shape (⊂) with a first end 164 that can be fixedly coupled (e.g., via welding) to the first foot assembly 160 and a second opposite end 166 that can be fixedly coupled (e.g., via welding) to the air tank 140. The first foot assembly 160 can include a first foot structure 170, which can be fixedly coupled to the air tank 140, and a pair of feet 172 that can be removably coupled to the first foot structure 170 with, for example, threaded fasteners 174 that threadably engage holes 176 formed in the first foot structure 170. In the example provided, the first foot structure 170 is a channel with side members 178 that are contoured to engage the air tank 140 in a manner that locates the first foot structure 170 to the air tank 140. The side members 178 can be welded to the air tank 140. The first foot structure 170 is sized to be received through the slotted bottom surface 88 of the triangular structures 86 associated with the first foot mount 40.

The second foot assembly 162 can be generally similar to the first foot assembly 160 but fixedly coupled to the handle 70 at a location that is spaced apart from the first foot assembly 160. In the particular example provided, however, the second foot assembly 162 includes a threaded hole 180 formed in the handle 70 and a foot assembly 182 that can be coupled to the threaded hole 182 via a threaded fastener 184. The foot assembly 182 can include a foot 172 and a spacer 186. The foot assembly 182 is sized to be received through the slotted bottom surface 88 of the triangular structures 86 associated with the second foot mount 42.

With reference to FIGS. 2, 3 and 8, the manifold assembly 22 can include a manifold conduit 200, an input pressure gauge 202, a pressure regulator 204, an output pressure gauge 206, a relief valve 208, a pressure switch 210, an input fitting 212 and a pair of output fittings 214.

The manifold conduit 200 can be a tubular casting or fabrication that can include various ports 220 that permit the various gauges, regulator, valve, switch and fittings thereto. The manifold conduit 200 can also include a plurality of posts 224 and a plurality of bosses 226. The posts 224 can correspond to the second bosses 58 (FIG. 4) in the second housing shell 32. The posts 224 can extend through the second bosses 58 (FIG. 4) to locate the manifold conduit 200 to the housing 12. Optionally, the distal ends of the posts 224 can be secured to the second housing shell 32 in an appropriate manner, such as a fastener (e.g., pushnuts, spring nuts) that engages (e.g., frictionally) the posts 224 or deformed such that each post 224 forms a rivet. Threaded fasteners 228 can be inserted through the bosses 226 and threadably coupled to the second housing shell 32 to fixedly couple the manifold conduit 220 to the housing 12. In the particular example provided, the manifold conduit 200 includes two transverse legs 230 and a gusset 232 is integrally formed with the legs 230 to strengthen the point at which the legs 230 intersect. The input fitting 212 can be any type of fitting and in the example provided is coupled in fluid communication with the hose (schematically shown in dashed line in FIG. 8) that is connected to the outlet fitting 144 of the air tank assembly 18. The pressure regulator 204 can include a housing 240 that can be integrally formed with the manifold conduit 200. An inlet (not specifically shown) to the housing 240 can be coupled in fluid communication with the input fitting 212 so as to be subjected to fluid pressure at the level of the fluid pressure in the air tank 140 (i.e., tank pressure). An outlet (not specifically shown) to the housing 240 can be coupled in fluid communication with the output fittings 214 and the output pressure gauge 206. The pressure regulator 204, which functions in a conventional manner, is employed to expand the air that is output from the outlet of the housing 240 to reduce its pressure (to a user-selected level) relative to the tank pressure. The input pressure gauge 202, the pressure switch 210 and the relief valve 208, all of which can be conventional in their construction and operation, can be coupled in fluid communication with the input fitting 212 so as to be exposed to tank pressure. It will be appreciated that the pressure switch 210, as well as the power cord 120 (FIG. 6) and a power switch 250 (FIG. 6), which is received in the switch aperture 108 (FIG. 6) are electrically coupled to the motor 14 to permit the motor 14 to be operated in a manner that is conventional and well known in the art. For example, the pressure switch 210 can be coupled to the motor 14 to halt operation of the motor 14 when the tank pressure exceeds a predetermined pressure. The output fittings 214 can be conventional quick-connect fittings.

Returning to FIG. 1, the input pressure gauge 202 and the output pressure gauge 206 are received in the first housing shell 30 and are visible through the gauge apertures 100. Accordingly, the input pressure gauge 202 and the output pressure gauge 206 are recessed into the housing 12 in a manner that protects the gauges if the air compressor package 10 were to be roughly handled. Similarly, the relief valve 208, the pressure regulator 204 and the output fittings 214 extend from the relief valve aperture 104, the regulator aperture 102 and the coupling apertures 106, respectively, by a limited distance that affords these components a degree of protection if the air compressor package 10 were to be roughly handled. Additionally, the portion of the housing 12 through which the gauge apertures 100, the regulator aperture 102 and the relief valve aperture 104 extend can be set back somewhat from a remainder of the front exterior surface of the housing 12. In this way, contact between the ground and the pressure regulator 204 can be avoided if the air compressor package 10 were to be placed with its front surface on the ground. Moreover, the portion of the housing 12 adjacent the coupling apertures 106 can be recessed inwardly of the outermost portion of the front surface such that the output fittings 214 are disposed in a pocket that provides space for a user to activate the quick-connect feature of the output fittings 214.

With reference to FIGS. 1 and 7, the air compressor package 10 can be positioned on its feet 172 (FIG. 2) in the orientation that is generally shown in FIG. 1 so that the air compressor package 10 may be operated in a first operating position. Alternately, the air compressor package 10 can be positioned such that its rear surface 258 is proximate the ground so that the air compressor package 10 may be operated in a second operating position. In this condition, the air compressor package 10 is supported by the cord wrap structure 116 and the first and second foot mounts 40 and 42. It will be appreciated that resilient feet (not shown) could be incorporated into the cord wrap structure 116 and the first and second foot mounts 40 and 42 that dampen the transmission of vibration between the air compressor package 10 and the ground. The resilient feet could be similar to the feet 172 (FIG. 2), or could comprise a resilient material that could be coupled to (e.g., overmolded onto) the cord wrap structure 116 and the first and second foot mounts 40 and 42.

The air compressor package 10 may be hand transported with a single hand of a user via a first portion 70*a* of the handle 70 to thereby transport the air compressor package 10 in an orientation that is identical to the "in-use" position of FIG. 1, or via a second portion 70*b* of the handle 70 to thereby transport the air compressor package 10 in an orientation that is perpendicular to the "in-use" position of FIG. 1. It will be appreciated that as the various gauges, regulator, valves and output fittings are positioned proximate or recessed inwardly from the front surface 260 of the air compressor package 10, the air compressor package 10 can be easily and ergonomically transported.

In the particular example provided, the air compressor package 10 has a weight of approximately 40 pounds, an overall length of about 29 inches, a height of about 15 inches and a depth of about 12 inches. The air compressor package 10 can have a center of gravity CG that can be located in a first vertical plane that extends through the equator of the air tank 140. In the example shown, the center of gravity CG is positioned in a second vertical plane that intersects a point at which the portion of the handle 70 enters the housing 12 proximate the air tank assembly 18. Also in the example provided, the center of gravity is positioned in a horizontal plane that intersects the second portion 70*b* of the handle 70 somewhat below the mid-point of the second portion 70*b*. The horizontal plane is perpendicular to the first and second vertical planes.

It will be appreciated, however, that the motor 14 and the compressor 16 could be repositioned or changed as desired to locate the center of gravity CG such that the second vertical plane intersects the first portion 70*a* of the handle between the two adjacent collars 72 and that the horizontal plane intersects a mid-point of the second portion 70*b* of the handle 70.

It will be appreciated from this disclosure that the air compressor package 10 may be stored in several orientations including on the floor or a shelf in either the first or second operating positions, and hanging from a hook (not shown) in either the first or second transport positions. Additionally, the portability of the air compressor package 10 can be further improved by incorporation of one or more wheels on an end of the air compressor package proximate the air tank assembly 18. The wheel(s) could permit an operator to hold the second portion 70*b* of the handle 70 and rotate the air compressor package 10 from the first operating position to an orientation intermediate the first and second transport positions while the wheel(s) is/are engaged to the ground. The second portion 70*b* of the handle 70 can be employed to pull the air compressor package 10 (while supported by the wheel (s)).

Another air compressor package constructed in accordance with the teachings of the present disclosure is illustrated in FIGS. 10 through 14 and generally indicated by reference numeral 10-1. Like the air compressor package 10 of FIG. 1, the air compressor package 10-1 can include a housing 12-1, a motor 14, a compressor 16, an air tank assembly 18-1, a frame assembly 20-1, and a manifold assembly 22. The motor 14, the compressor 16 and the manifold assembly 22 can be configured in a manner that is similar to that which is described above and as such, further illustration and/or discussion of the motor 14, the compressor 16 and the manifold assembly 22 need not be provided.

The housing 12-1 can include a first housing shell 30-1 and a second housing shell 32-1. The first and second housing shells 30-1 and 32-1 can be formed of a plastic material and can cooperate to define an internal cavity 34-1, a plurality of vents 36-1, a handle mount 38-1, a pair of first feet 40-1 (only one shown), a pair of second feet 42-1, a tank mount 44-1, a plurality of gauge apertures 100-1, a regulator aperture 102-1, a relief valve aperture 104-1, a pair of coupling apertures 106-1, a switch aperture 108-1 and a cord aperture 110-1. The housing 12-1 can be constructed similar to the housing 12 of FIGS. 2 through 4 and can include a plurality of partition walls (not shown) that can define a motor/compressor mount (not shown) in the internal cavity 34-1 into which the motor 14 and the compressor 16 can be received. Alternatively, the frame assembly 20-1 can include a plate structure (not shown) that can be received in the internal cavity 34-1 to which the motor 14 and the compressor 16 can be mounted. The vents 36-1 can be formed through one or both of the first and second housing shells 30-1 and 32-1 and can permit air to be drawn into and dispensed from the internal cavity 34-1 (e.g., for cooling the motor 14 and/or the compressor 16).

The handle mount 38-1 can define a structure that can be configured to engage a handle 70-1, which is associated with the frame assembly 20-1, when the housing 12-1 is assembled to the frame assembly 20-1. In the particular example provided, the handle mount 38-1 defines a first recessed area 80-1, which is disposed on a front side of the air compressor package 10-1, a second recessed area 82-1, which is disposed on a lateral side of the air compressor package 10-1 between the first recessed area 80-1 and the air tank assembly 18-1, and a groove 300 into which a portion of the handle 70-1 can be received. The first and second recessed areas 80-1 and 82-1 can provide clearance between the handle 70-1 and the exterior surface of the housing 12-1 in which the user may insert their hand to grasp the handle 70-1 so that the air compressor package 10-1 may be carried in various orientations (see FIGS. 13 and 14).

The first feet 40-1 can include a pair of resilient feet 304 (only one shown) that can be coupled to the second housing shell 32-1 to support the air compressor package 10-1 when it is oriented on its bottom. If the frame assembly 20-1 includes a plate structure (not shown) to which the motor 14 and the compressor 16 are mounted, the resilient feet 304 could alternatively be coupled to the plate structure and could extend through apertures (not shown) in the housing 12-1.

The second feet 42-1 can be disposed on opposite lateral sides of the air compressor package 10-1 to support the air compressor package 10-1 when it is oriented on its lateral side that is opposite the groove 300 in the housing 12-1. The second feet 42-1 can be defined by structures 310 (only one shown) that can extend outwardly from the first and second housing shells 30-1 and 32-1 on a side of the housing 12-1 opposite the groove 300. The structures 310 can be slotted to receive respective portions of the frame assembly 20-1.

The tank mount 44-1 can include structure that can partially or completely shroud the air tank assembly 18-1. Configuration in this manner is optional, but provides an aesthetically cohesive appearance that can be desirable. In the particular example provided, the tank mount 44-1 is configured to partially shroud the air tank assembly 18-1, as well as to shroud the connection(s) between the air tank assembly 18-1, the compressor 16 and the manifold assembly 22.

Figure 11:
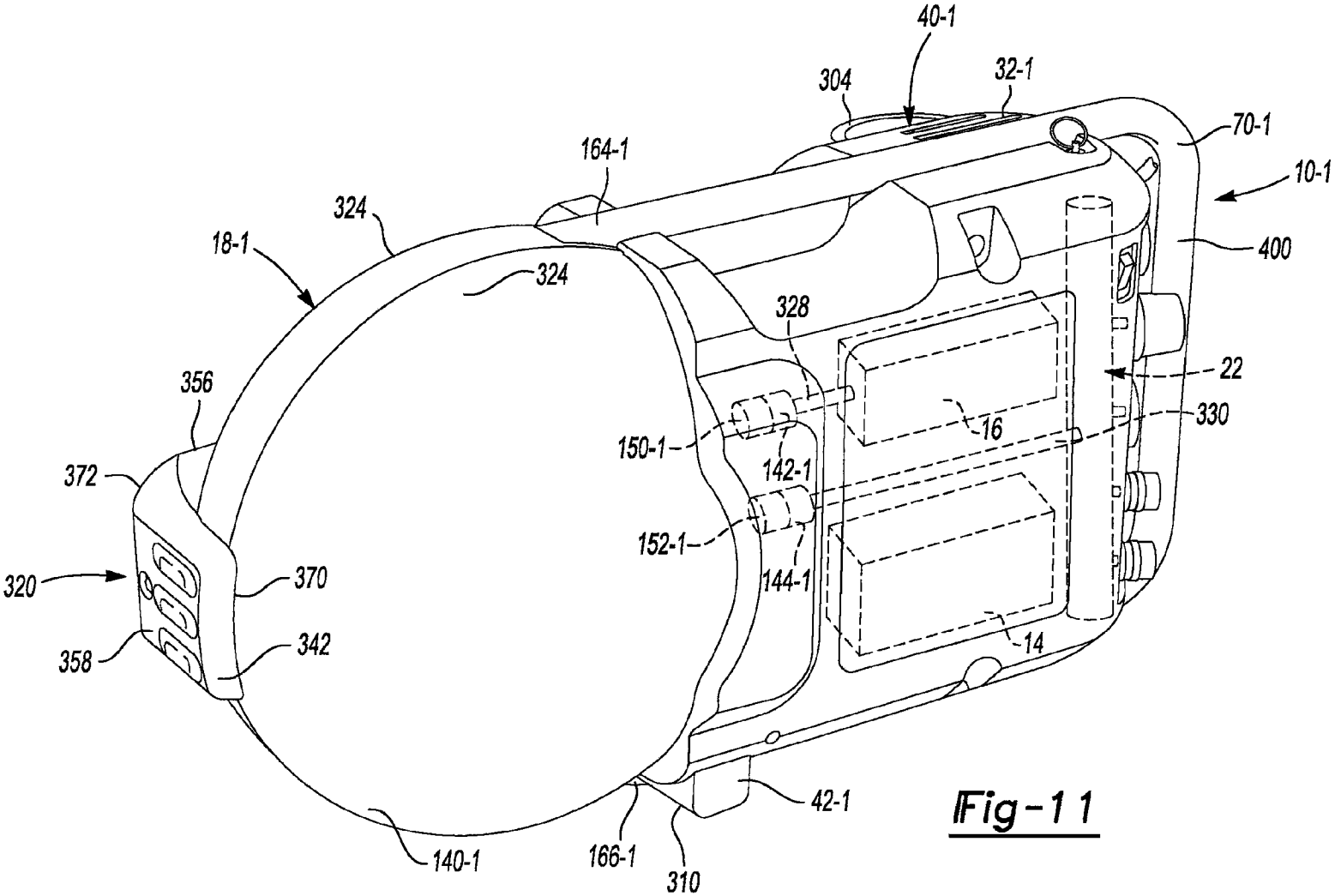
FIG. 11 is a perspective view of the air compressor package of FIG. 10 illustrating the air compressor package in a transport orientation.
Figure 12:
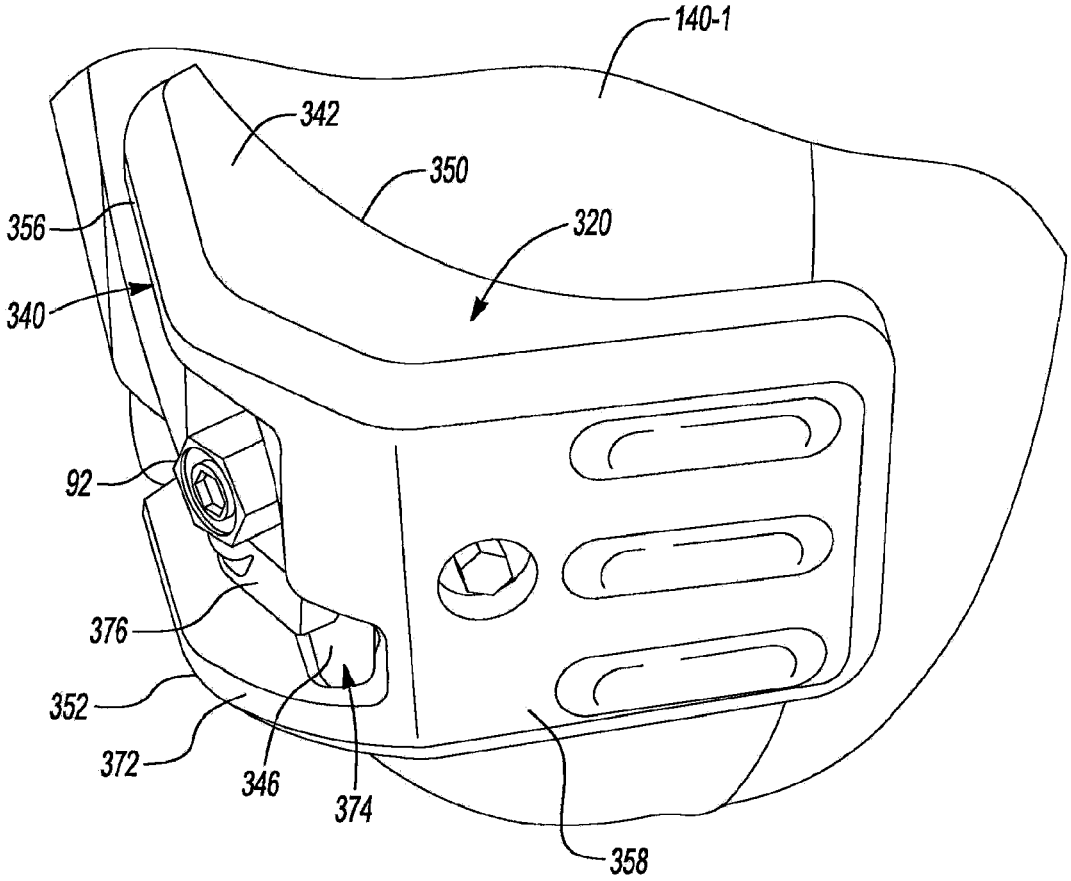
FIG. 12 is a perspective view of a portion of the air compressor package of FIG. 10 illustrating the foot assembly in more detail.

With reference to FIGS. 11 and 12, the air tank assembly 18-1 can include an air tank 140-1, a foot assembly 320, an inlet fitting 142-1, an outlet fitting 144-1 and a drain valve 92. The air tank 140-1 can be a "pancake style" tank having a pair of convex tank members 324 that can be welded to one another about the equator of the air tank 140-1. In the particular example provided, the air tank 140-1 is about 14 inches in diameter and about 10 inches in depth and has a capacity of about 4 gallons. The air tank 140-1 can include an inlet boss 150-1, which is configured to receive the inlet fitting 142-1, an outlet boss 152-1, which is configured to receive the outlet fitting 144-1, and a drain boss 154-1 that is configured to receive the drain valve 92. The inlet fitting 142-1 can be configured to be connected to a fluid conduit, such as a hose 328, connected to the compressor 16, to thereby couple the air tank 140-1 in fluid connection with the compressor 16. The inlet fitting 142-1 can include a check valve (not shown) that can inhibit compressed air from returning to the compressor 16 from the air tank 140-1. The outlet fitting 144 can be configured to be connected to a fluid conduit 330, such as a hose, that can be coupled in fluid communication to the manifold assembly 22.

The foot assembly 320 can include a bracket 340 and a foot member 342. The bracket 340 can be generally C-shaped, having a first end that can be fixedly coupled (e.g., welded) to the air tank 140-1 at an appropriate position, such as proximate the bottom surface of the air tank 140-1, and a second end that can extend around the rear side of the air tank 140-1. The bracket 340 can include a fitting aperture 346 through which the drain valve 92 can be received.

Figure 13:
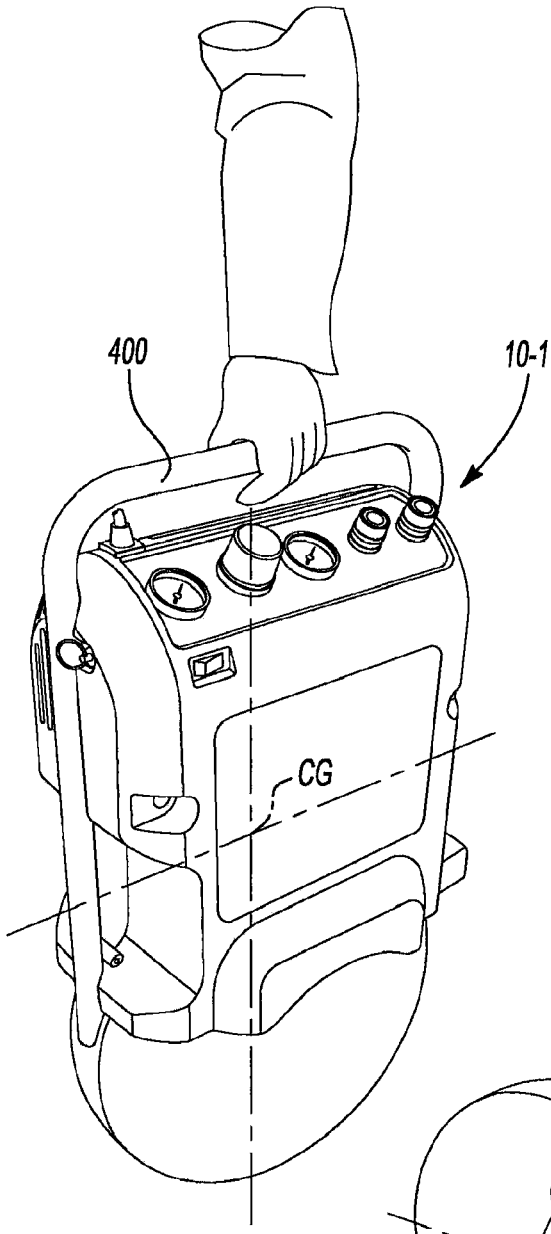
FIGS. 13 and 14 are perspective views of the air compressor package of FIG. 10 in first and second transport orientations, respectively.
Figure 14:
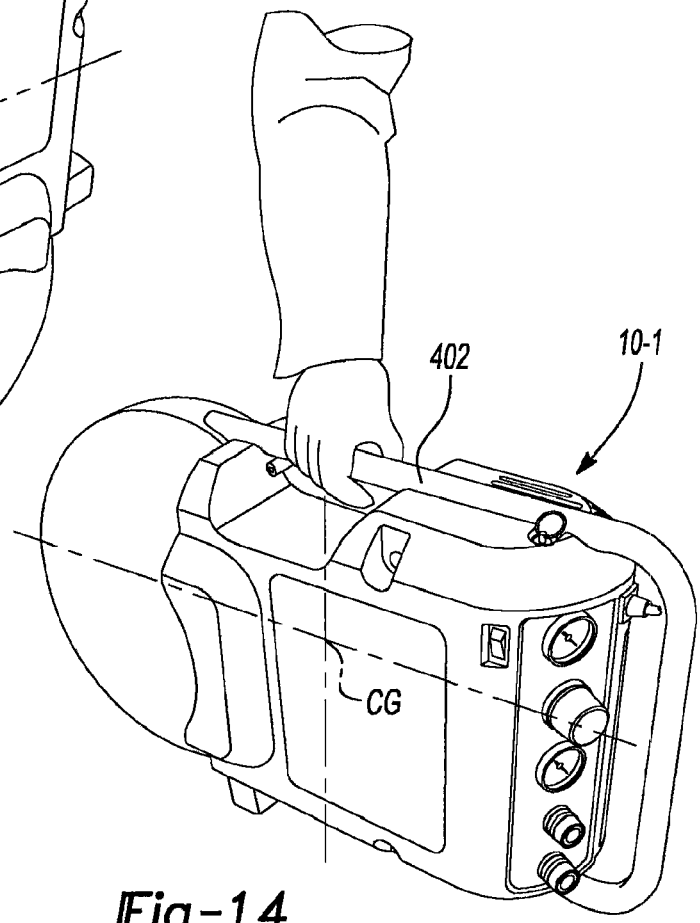

The foot member 342 can be formed of a resilient material and can be coupled to the bracket 340. In the particular example provided, the foot member 342 has an inner surface 350 that is shaped to conform to the exterior surface of the air tank 140-1 and an outer surface 352 that is generally L-shaped with an arm 356 and a leg 358. The arm 356 of the outer surface 352 can be configured to shroud drain valve 92 and support the air compressor package 10-1 when the air compressor package 10-1 is resting on the resilient feet 304 to thereby support the air compressor package 10-1 when it is oriented on its bottom. The leg 358 of the outer surface 352 can extend over the rear end 370 of the air tank 140-1. A transition zone 372 between the arm 356 and the leg 358 can be arcuate in shape to facilitate the positioning of the air compressor package 10-1 from an operating position (shown in FIG. 10 in which the air compressor package 10-1 is placed on its bottom so that the air compressor package 10-1 is resting on the resilient feet 304 and the arm 356 of the foot member 342) to a first transport position that is shown in FIG. 13. The foot member 342 can define a recess 374 that provides sufficient space for the lever 376 of the valve 92 to be turned through an angle of 90 degrees to permit the valve 92 to be opened and closed.

Returning to FIGS. 10 and 11, the frame assembly 20-1 can include the handle 70-1, which can be formed of a suitable metal tubing that can be formed in a widened C-shape (⊂) with first and second end 164-1 and 166-1, respectively, that can be fixedly coupled (e.g., via welding) to the air tank 140-1. The handle 70-1 can define a first handle portion 400, which can be disposed forwardly of the first recessed area 80-1 of the housing 12-1, and a second handle portion 402 that can be disposed proximate the second recessed area 82-1 of the housing 12-1. Optionally, a plate structure can be coupled to the handle 70-1 (e.g., spanning the widened C-shape tube) and can be employed to mount the motor 14, the compressor 16 and/or the resilient feet 304.

The manifold assembly 22 can be similar to the manifold assembly 22 of FIGS. 2, 3 and 8 and can include a manifold conduit 200, an input pressure gauge 202, a pressure regulator 204, an output pressure gauge 206, a relief valve 208, a pressure switch (not shown) and a pair of output fittings 214. The manifold conduit 200 can be received in the internal cavity 34-1 of the housing 12-1 and can be employed to couple the various gauges, regulators, valves, pressure switch and fittings in fluid communication with the air tank 140-1 in the manner that is described in detail, above.

The input pressure gauge 202 and the output pressure gauge 206 can be received in the housing 12-1 and can extend through the gauge apertures 100-1 in the housing 12-1. The pressure regulator 204 can be received in the housing 12-1 and can extend through the regulator aperture 102-1. The relief valve 208 can be received in the housing 12-1 and can extend through the relief valve aperture 104-1. The output fittings 214 can extend through the coupling apertures 106-1. A power switch 250-1 can be mounted to the housing 12-1 and can extend through the switch aperture 108-1, while a power cord 120-1 can extend through the cord aperture 110-1. The power switch 250-1 and the power cord 120-1 can be electrically coupled to the motor 14.

The housing 12-1 and the frame assembly 20-1 can be configured to protect the gauges 202, 206, regulator 204, relief valve 208, output fittings 214, power switch 250-1 and power cord 120-1. For example, the housing 12-1 can be recessed in the areas in which one or more of these components are situated and/or the frame assembly 20-1 can extend outwardly from one or more of these components. A switch recess 450 in the first housing shell 30-1 can be formed proximate the switch aperture 108-1. The switch recess 450 positions the power switch 250-1 below a plane defined by the top surface 452 of the air compressor package 10-1 to guard against unintended contact between the power switch 250-1 and an object when the air compressor package 10-1 is stored.

A gauge panel recess 456 can be formed into a front of the housing 12-1 above the first handle portion 400. The pressure gauges 202 and 206 can extend to a level at or below the raised portion 458 of the housing 12-1 that surrounds the gauge panel recess 456, while the regulator 204 and the output fittings 214 can extend outwardly so that their distal ends are disposed between the plane that is defined by the top surface 452 of the air compressor package 10-1 and the first handle portion 400 to thereby guard against unintended contact between these components and an object when the air compressor package 10-1 is stored. The relief valve 92 can be recessed within the housing 12-1 and positioned proximate the frame assembly 20-1 to thereby guard against unintended contact between the relief valve 92 and an object when the air compressor package 10-1 is stored.

With reference to FIGS. 10, 11, 13 and 14, it will be appreciated by those of ordinary skill in the art that the air compressor package 10-1 can have an operating position or orientation (shown in FIG. 10), in which the air compressor package 10-1 is positioned on its bottom and rests on the resilient feet 304 and the arm 356 of the foot member 342 (FIG. 12), a first transport position or orientation (shown in FIG. 13) in which the air compressor package 10-1 is hand carried by the first handle portion 400, and a second transport position or orientation (shown in FIG. 14) in which the air compressor package 10-1 is hand carried by the second handle portion 402. It will be appreciated that the air compressor package 10-1 includes a center of gravity (Cg) that is disposed in a plane that extends through the longitudinal axes of the first and second handle portions 400 and 402, which is disposed vertically in-line with a center of the first handle portion 400 when the air compressor package 10-1 is transported in the first transport position, and which is disposed vertically in-line with a center of the second handle portion 402 when the air compressor package 10-1 is transported in the second transport position.

With reference to FIGS. 11 through 13, the foot assembly 320 can be employed to facilitate movement of the air compressor package 10-1 from the operating position to the first transport position. In this regard, a user can grasp the first handle portion 400 and pull upwardly on the first handle portion 400 to rotate the air compressor package 10-1 on the foot assembly 320 such that the air compressor package 10-1 is rotated from the arm 356 of the foot member 342 to the leg 358 of the foot member 342. Similarly, the user can facilitate movement of the air compressor package 10-1 from the first transport position to the operating position by resting the air compressor package 10-1 on the leg 358 of the foot member 342, grasping the first handle portion 400 with one or more hands, and lowering the first handle portion 400 to rotate the air compressor package 10-1 from the leg 358 of the foot member 342 to the arm 356 of the foot member 342.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. An air compressor package comprising:

a pancake air tank having a pair of convex tank members that are coupled to one another about an equator of the pancake air tank;

a handle having opposite ends coupled to the equator of the pancake air tank;

a housing coupled to the pancake air tank and the handle, the housing defining an internal cavity and sized to surround only a portion of the pancake air tank and only a portion of the handle;

a motor disposed in the cavity; and a compressor disposed in the cavity and driven by the motor, the compressor being coupled in fluid communication with the pancake air tank;

wherein the motor and the compressor are arranged relative to the pancake air tank such that a plane taken through the equator of the pancake air tank passes through the motor and the compressor; and wherein the plane extends longitudinally through the entire handle.

2. The air compressor package of claim 1, wherein the plane passes through a rotational axis of the motor.

3. The air compressor package of claim 2, wherein the compressor includes a compressor pulley and the plane passes through a rotational axis of the compressor pulley.

4. An air compressor package comprising:

a pancake air tank having a pair of convex tank members that are coupled to one another about an equator of the pancake air tank;

a handle having a widened C-shape with opposite terminal ends fixed to the equator of the pancake air tank, the entire handle extending parallel to a plane that extends through the equator of the pancake air tank;

a housing coupled to the air tank and the handle so as to only partially shroud each of the air tank and the handle;

a motor housed in the housing; and a compressor housed in the housing and driven by the motor, the compressor being coupled in fluid communication with the pancake air tank;

wherein the motor and the compressor are disposed between the pancake air tank and the handle.

5. An air compressor package comprising:

a pancake air tank having a pair of convex tank members that are coupled to one another about an equator of the pancake air tank;

a handle coupled to the pancake air tank, the handle including a first handle portion and a second handle portion;

a housing coupled to the pancake air tank and the handle, the housing defining an internal cavity and only partially shrouding the pancake air tank, and the housing only partially shrouding the handle so as to form recessed portions spaced apart from the handle and each other that define the first handle portion and the second handle portion;

a motor housed in the internal cavity;

a compressor housed in the internal cavity and driven by the motor, the compressor being in fluid communication with the pancake air tank; and a manifold assembly coupled in fluid communication with the pancake air tank, the manifold assembly including a gauge, a regulator and an outlet coupling;

wherein the air compressor package has a first operating position in which the equator of the pancake air tank is positioned vertically and the first portion of the handle is generally parallel to a first surface on which the air compressor package is positioned, wherein the air compressor package has a first hand-carried transport position in which the first portion of the handle is adapted to be engaged by a single hand of a user to transport the air compressor package such that the first portion of the handle is disposed above the pancake air tank, wherein the air compressor package has a second hand-carried transport position in which the second portion of the handle is adapted to be engaged by the single hand of the user to transport the air compressor package such that the second portion of the handle is disposed above the pancake air tank, and wherein the second transport position is rotated by an angle of about 90 degrees from the first transport position; and wherein the motor and the compressor are housed in the housing when the air compressor package is positioned in the first operating position, the first hand-carried transport position and the second hand-carried transport position.

6. The air compressor package of claim 5, wherein the air compressor package has a second operating position in which the equator of the pancake air tank is positioned horizontally.

7. The air compressor package of claim 5, wherein the handle has a widened C-shape.

8. The air compressor package of claim 5, wherein the housing defines a front exterior surface and wherein the gauge and the regulator are located within the housing such that the gauge and the regulator do not contact the first surface when the front exterior surface is positioned in contact with the first surface.

9. The air compressor package of claim 5, wherein the housing defines a pocket recessed from the surrounding exterior surface of the housing and into which the outlet coupling is disposed so as to be substantially contained within the pocket and not contact the first surface when the surrounding exterior surface is positioned in contact with the first surface.

10. The air compressor package of claim 4, wherein the handle is at least partially formed of a length of tubular material.

11. The air compressor package of claim 10, wherein the tubular material has a central axis that is disposed in the plane.

12. The air compressor package of claim 4, further comprising a foot coupled directly to the pancake air tank, the foot being disposed on a side of the pancake air tank opposite the handle.

13. The air compressor package of claim 12, wherein the foot includes an L-shaped bracket that is fixedly coupled to the pancake air tank at least about the equator, and a foot member that is formed of a resilient material and coupled to the L-shaped bracket.

14. The air compressor package of claim 13, further comprising a drain valve coupled to the pancake air tank at a location that is shrouded by the foot.

15. The air compressor package of claim 1, wherein the housing further comprises a pair of housing shells that are disposed on opposite sides of the plane, each of the housing shells shrouding only a portion of the handle and only a portion of an associated one of the convex tank members.

16. The air compressor package of claim 15, wherein one of the housing shells includes a gauge panel recess, which slopes rearwardly and upwardly from the handle, and a raised portion that is disposed about the gauge panel recess, and wherein at least one of a gauge, a regulator and an output fitting is disposed in the gauge panel recess.

17. The air compressor package of claim 1, further comprising a foot coupled directly to the pancake air tank, the foot being disposed on a side of the pancake air tank opposite the handle.

18. The air compressor package of claim 17, wherein the foot includes an L-shaped bracket that is fixedly coupled to the pancake air tank at least about the equator, and a foot member that is formed of a resilient material and coupled to the bracket.

19. The air compressor package of claim 18, further comprising a drain valve coupled to the pancake air tank at a location that is shrouded by the foot.

20. The air compressor package of claim 5, wherein the entire handle extends parallel to a plane extending through the equator of the pancake air tank.

* * * * *